US009916952B2

(12) United States Patent
Blackmon et al.

(10) Patent No.: US 9,916,952 B2
(45) Date of Patent: Mar. 13, 2018

(54) CARRIER SUB-ASSEMBLY FOR AN ELECTRICAL RELAY DEVICE

(71) Applicants: TYCO ELECTRONICS CORPORATION, Berwyn, PA (US); Tyco Electronics Mexico, S. de R.L. de C.V., Tlalnepantla (MX); AMP Amermex S.A. de C.V., Hermosillo (MX)

(72) Inventors: Terrance Edward Blackmon, Winston-Salem, NC (US); Thomas Michael Banas, Kernersville, NC (US); Darnell Lathal Drummond, Winston-Salem, NC (US); Roger L. Thrush, Clemmons, NC (US); Daniel Enrique Juarez Gerardo, Guaymas (MX); Jose Antonio Felix Moreno, Guaymas (MX)

(73) Assignees: TE CONNECTIVITY CORPORATION, Berwyn, PA (US); TYCO ELECTRONICS MEXICO, S. de R.L. de C.V., Tlalnepantla (MX); AMP AMERMEX S.A. de C.V., Hermosillo (MX)

( * ) Notice: Subject to any disclaimer, the term of this patent is extended or adjusted under 35 U.S.C. 154(b) by 0 days.

(21) Appl. No.: 15/167,231

(22) Filed: May 27, 2016

(65) Prior Publication Data

US 2016/0365209 A1 Dec. 15, 2016

Related U.S. Application Data

(60) Provisional application No. 62/174,558, filed on Jun. 12, 2015.

(51) Int. Cl.
*H01H 50/04* (2006.01)
*H01H 51/06* (2006.01)
(Continued)

(52) U.S. Cl.
CPC ..... *H01H 50/041* (2013.01); *H01H 50/042* (2013.01); *H01H 51/065* (2013.01);
(Continued)

(58) Field of Classification Search
CPC ..... H01H 50/20; H01H 50/60; H01H 50/641; H01H 50/041
See application file for complete search history.

(56) References Cited

U.S. PATENT DOCUMENTS 8,179,217 B2 * 5/2012 Kawaguchi ..... H01F 7/1615 335/124
8,324,995 B1 * 12/2012 Takahama ..... H01H 51/065 335/131
(Continued)

FOREIGN PATENT DOCUMENTS

EP 1768152 A1 3/2007
EP 2674958 A1 12/2013
(Continued)

OTHER PUBLICATIONS

International Search Report, International Application No. PCT/US2016/038349, International Filing Date Jun. 20, 2016.

*Primary Examiner* — Bernard Rojas

(57) ABSTRACT

A carrier sub-assembly for an electrical relay device includes a plunger and a shaft. The plunger is formed of a ferromagnetic material. The plunger has a generally cylindrical shape extending between a top side and a bottom side of the plunger. The shaft extends between a contact end and an opposite plunger end. The shaft is directly secured to the plunger without a discrete component between the shaft and the plunger securing the shaft to the plunger. The shaft and the plunger are configured to move together within the electrical relay device. A segment of the shaft including the contact end protrudes from the top side of the plunger for securing to a movable contact of the electrical relay device.

19 Claims, 5 Drawing Sheets

(51) Int. Cl.
*H01H 50/64* (2006.01)
*H01H 50/20* (2006.01)
*H01H 1/20* (2006.01)

(52) U.S. Cl.
CPC ..... *H01H 1/2008* (2013.01); *H01H 50/045* (2013.01); *H01H 50/20* (2013.01); *H01H 50/641* (2013.01)

(56) References Cited

U.S. PATENT DOCUMENTS

| | | | | |
|---|---|---|---|---|
| 8,446,239 | B2 * | 5/2013 | Niimi | H01H 50/22 335/126 |
| 9,431,200 | B2 * | 8/2016 | Choi | H01H 51/065 |
| 2004/0031668 | A1 | 2/2004 | Duchemin et al. | |
| 2010/0026427 | A1 | 2/2010 | Moeller et al. | |
| 2011/0080240 | A1 * | 4/2011 | Patino | H01H 51/2209 335/229 |
| 2015/0187527 | A1 * | 7/2015 | Kubono | H01H 50/44 361/206 |
| 2015/0206685 | A1 * | 7/2015 | Naka | H01H 50/02 335/187 |
| 2016/0155592 | A1 * | 6/2016 | Ito | H01H 50/36 335/187 |

FOREIGN PATENT DOCUMENTS

| | | | |
|---|---|---|---|
| WO | 2013159169 | A2 | 10/2013 |
| WO | 2014093045 | A1 | 6/2014 |

* cited by examiner

CARRIER SUB-ASSEMBLY FOR AN ELECTRICAL RELAY DEVICE

CROSS-REFERENCE TO RELATED APPLICATIONS

This application claims priority to U.S. Provisional Application No. 62/174,558, filed 12 Jun. 2015, which is incorporated by reference in its entirety.

BACKGROUND OF THE INVENTION

The subject matter herein relates generally to electrical relay devices.

Electrical relay devices are generally electrically operated switches used to control the presence or absence of current flowing through a circuit from a power source to one or more other electrical components. The power source may be one or more batteries, for example. Some electrical relays use an electromagnet to mechanically operate a switch. The electromagnet may physically move a movable electrical contact relative to one or more stationary contacts. The movable electrical contact may form or close a circuit (allowing current to flow through the circuit) when the movable contact engages one or more of the stationary contacts. Moving the movable electrical contact away from the stationary contact(s) breaks or opens the circuit.

At least some electrical relay devices include a ferromagnetic element that is disposed at least proximate to the electromagnet such that an induced magnetic field applies a magnetic force upon the ferromagnetic element that translates the ferromagnetic element relative to the electromagnet. The ferromagnetic element is coupled to a shaft, which extends from the ferromagnetic element to the movable electrical contact. The shaft is coupled to both the ferromagnetic element and the movable electrical contact. Therefore, movement of the ferromagnetic element due to the induced electrical field causes movement of the shaft and the movable electrical contact towards and away from the stationary contacts, forming or braking a circuit, as described above.

Known electrical relay devices have some disadvantages. For example, the coupling between the shaft and the ferromagnetic element in some known electrical relay devices is made via a separate fastener. An additional fastener is used to couple the shaft to the moving electrical contact. The particular fasteners used in some known relay devices are retaining rings, such as E-clips or C-clips. But, since the retaining rings are separate fasteners that are installed to engage to discrete parts, the retaining rings are prone to moving out of position, and even falling off of the parts completely. The electrical relay devices may be used on vehicles, such as trains and automobiles. Vibrations and other forces encountered during use and/or improper installment during assembly may cause the retaining rings to loosen, dislodge, and finally fall off. At such time, the shaft may uncouple from the ferromagnetic element and/or the movable electrical contact. In either event, the movable electrical contact would no longer be coupled, indirectly via the shaft, to the ferromagnetic element, such that translation of the ferromagnetic element would not control movement of the movable electrical contact and the electrical relay device would cease to function until the fasteners or new fasteners are replaced.

A need remains for an electrical relay device that does not use separate fasteners to couple the shaft to the movable electrical contact and to the ferromagnetic element.

BRIEF DESCRIPTION OF THE INVENTION

In an embodiment, a carrier sub-assembly for an electrical relay device is provided that includes a plunger and a shaft. The plunger is formed of a ferromagnetic material. The plunger has a generally cylindrical shape extending between a top side and a bottom side of the plunger. The shaft extends between a contact end and an opposite plunger end. The shaft is directly secured to the plunger without a discrete component between the shaft and the plunger securing the shaft to the plunger. The shaft and the plunger are configured to move together within the electrical relay device. A segment of the shaft including the contact end protrudes from the top side of the plunger for securing to a movable contact of the electrical relay device.

In another embodiment, an electrical relay device is provided that includes a housing, two stationary contacts, a coil of wire, and an actuator assembly. The stationary contacts are held within the housing and spaced apart from one another. The coil of wire is within the housing and is electrically connected to a relay power source. The actuator assembly is disposed partially within the coil of wire within the housing. The actuator assembly includes a movable contact coupled to a carrier sub-assembly. The actuator assembly is configured to move along an actuation axis between a first position and a second position based on a presence or absence of a magnetic field induced by current through the coil of wire. The movable contact of the actuator assembly is spaced apart from the stationary contacts when the actuator assembly is in the first position. The movable contact engages the stationary contacts to provide a closed circuit path between the stationary contacts when the actuator assembly is in the second position. The carrier sub-assembly includes a plunger and a shaft directly secured to one another without a discrete component between the shaft and the plunger securing the shaft to the plunger. The plunger is formed of a ferromagnetic material. The shaft protrudes from a top side of the plunger and extends to a contact end. The contact end of the shaft is directly secured to the movable contact without a discrete component between the shaft and the movable contact securing the shaft to the movable contact. The contact end of the shaft is defined by at least two deflectable prongs that extend through an aperture in the movable contact.

DETAILED DESCRIPTION OF THE INVENTION

Figure 1:
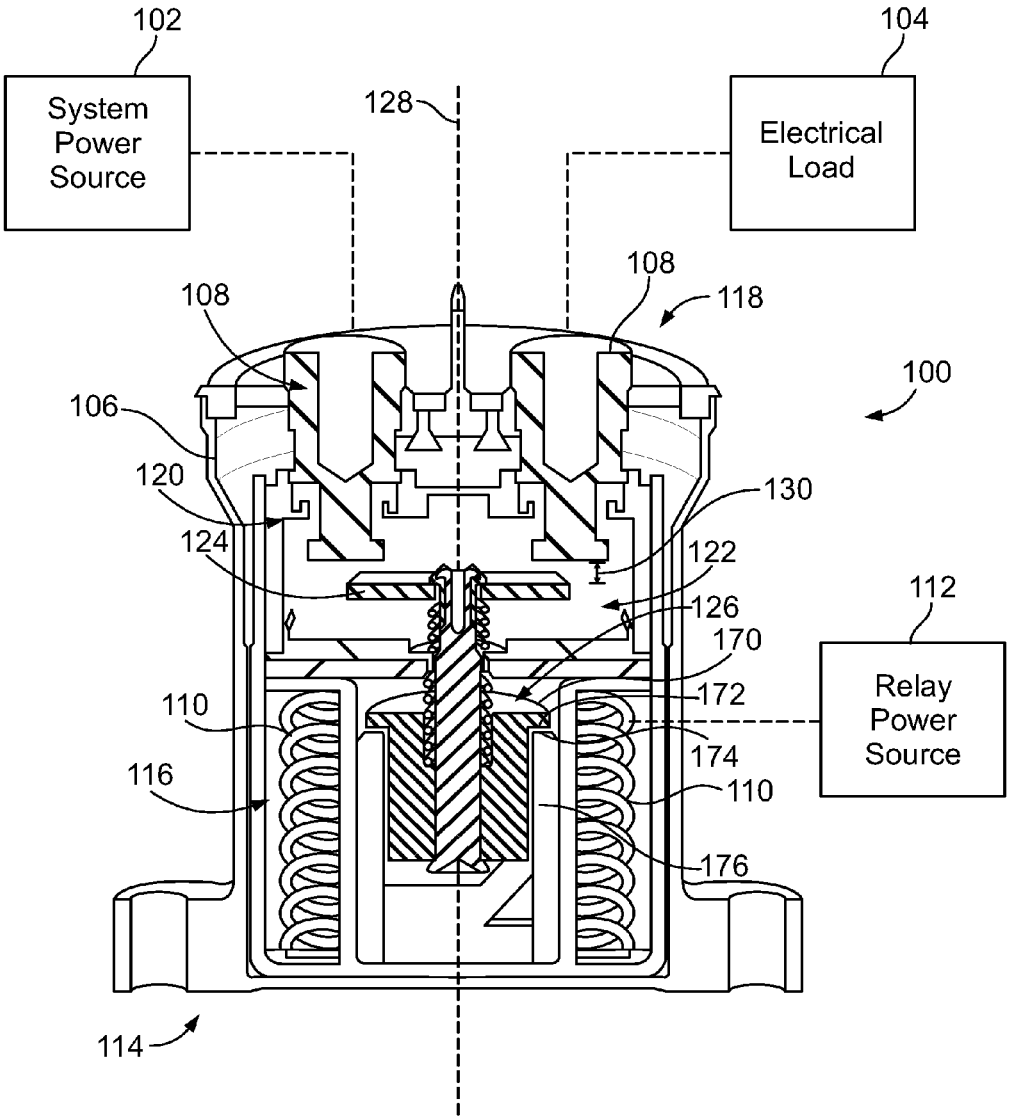
FIG. 1 is a front cross-sectional view of an electrical relay device formed in accordance with an embodiment.

FIG. 1 is a front cross-sectional view of an electrical relay device 100 formed in accordance with an embodiment. The electrical relay device 100 is an electrically operated switch. For example, the electrical relay device 100 is used to control the presence or absence of current flowing through a circuit. The electrical relay device 100 may close (or form) the circuit to allow current to flow through the circuit, and the electrical relay device 100 may open (or break) the circuit to stop the flow of current through the circuit. The electrical relay device 100 is operated to selectively close and open the circuit. Optionally, the circuit may provide a conductive path between a system power source 102 and an electrical load 104 in the system. The system may be a vehicle, such as a train car, an automobile, an off-road vehicle, or the like. When the electrical relay device 100 closes the circuit, electrical current from the system power source 102 flows to the electrical load 104 to power the electrical load 104. The system power source 102 may be one or more batteries, for example. The electrical load 104 may be one or more electrical components, such as lighting systems, motors, heating and/or cooling systems, and the like within the system. The electrical relay device 100 in an embodiment may be installed within a vehicle to control the flow of current from a battery (or a series of batteries) to electrical components on the vehicle (for example, headlights, interior lights, radio, navigation display, etc.) to power the electrical components. Alternative, or in addition, the circuit may provide a conductive path for electrical energy to flow from the electrical load 104 to the power source 102 in order to re-charge the power source 102. For example, during regenerative braking, energy is converted to electrical current which may be routed from the brakes through the electrical relay device 100 to the battery (or batteries) of the vehicle.

The electrical relay device 100 includes a housing 106 and various components within the housing 106. The relay device 100 includes two stationary contacts 108 held within the housing 106. The stationary contacts 108 are spaced apart from one another to prevent current from flowing directly between the two stationary contacts 108. The relay device 100 further includes a coil 110 of wire within the housing 106. The wire coil 110 is electrically connected to a relay power source 112, which provides electrical energy to the wire coil 110 in order to induce a magnetic field. The relay power source 112 is operated to selectively control the magnetic field induced by the current through the wire coil 110. In an embodiment, the wire coil 110 is spaced apart from the stationary contacts 108 within the housing 106. For example, the wire coil 110 in the illustrated embodiment is disposed proximate to a mounting end 114 of the housing 106 in an electromagnetic region 116 of the housing 106. The stationary contacts 108, on the other hand, are disposed more proximate to a top end 118 of the housing 106 within an electrical circuit region 120 of the housing 106. As used herein, relative or spatial terms such as "top," "bottom," "front," "rear," "left," and "right" are only used to distinguish the referenced elements and do not necessarily require particular positions or orientations in the electrical relay device 100 or in the surrounding environment of the electrical relay device 100.

The electrical relay device 100 further includes an actuator assembly 122 within the housing 106. The actuator assembly 122 is disposed partially within the wire coil 110. The actuator assembly 122 includes a movable contact 124 that is coupled to a carrier sub-assembly 126. The movable contact 124 is coupled to the carrier sub-assembly 126 such that the movable contact 124 moves with the carrier sub-assembly 126. The movable contact 124 is located within the electrical circuit region 120 of the housing 106, while part of the carrier sub-assembly 126 is located within the electromagnetic region 116, surrounded by the wire coil 110. In an embodiment, the actuator assembly 122 is configured to move along an actuation axis 128 between a first position and a second position based on a presence or absence of a magnetic field induced by current through the wire coil 110. The actuator assembly 122 moves along the actuation axis 128 by translating towards and away from the top end 118 of the housing 106, for example. The actuator assembly 122 is moved by a magnetic force that acts upon the carrier sub-assembly 126. For example, when the relay power source 112 applies a current to the wire coil 110, the current through the wire coil 110 induces a magnetic field that acts on the portion of the carrier sub-assembly 126 located within the electromagnetic region 116 of the housing 106, causing the carrier sub-assembly 126 and the movable contact 124 coupled thereto to move along the actuation axis 128. When the current from the relay power source 112 ceases, the wire coil 110 no longer induces the magnetic field that acts upon the carrier sub-assembly 126, and the actuator assembly 122 returns to a starting position.

FIG. 1 shows the actuator assembly 122 in the first position. When the actuator assembly 122 is in the first position, the movable contact 124 is spaced apart from the stationary contacts 108 such that the movable contact 124 is not directly engaged with or conductively connected with either of the stationary contacts 108. The movable contact 124 is separated from the stationary contacts 108 by a gap 130 that extends along the actuation axis 128. The first position of the actuator assembly 122 may be referred to herein as an open circuit position.

Figure 2:
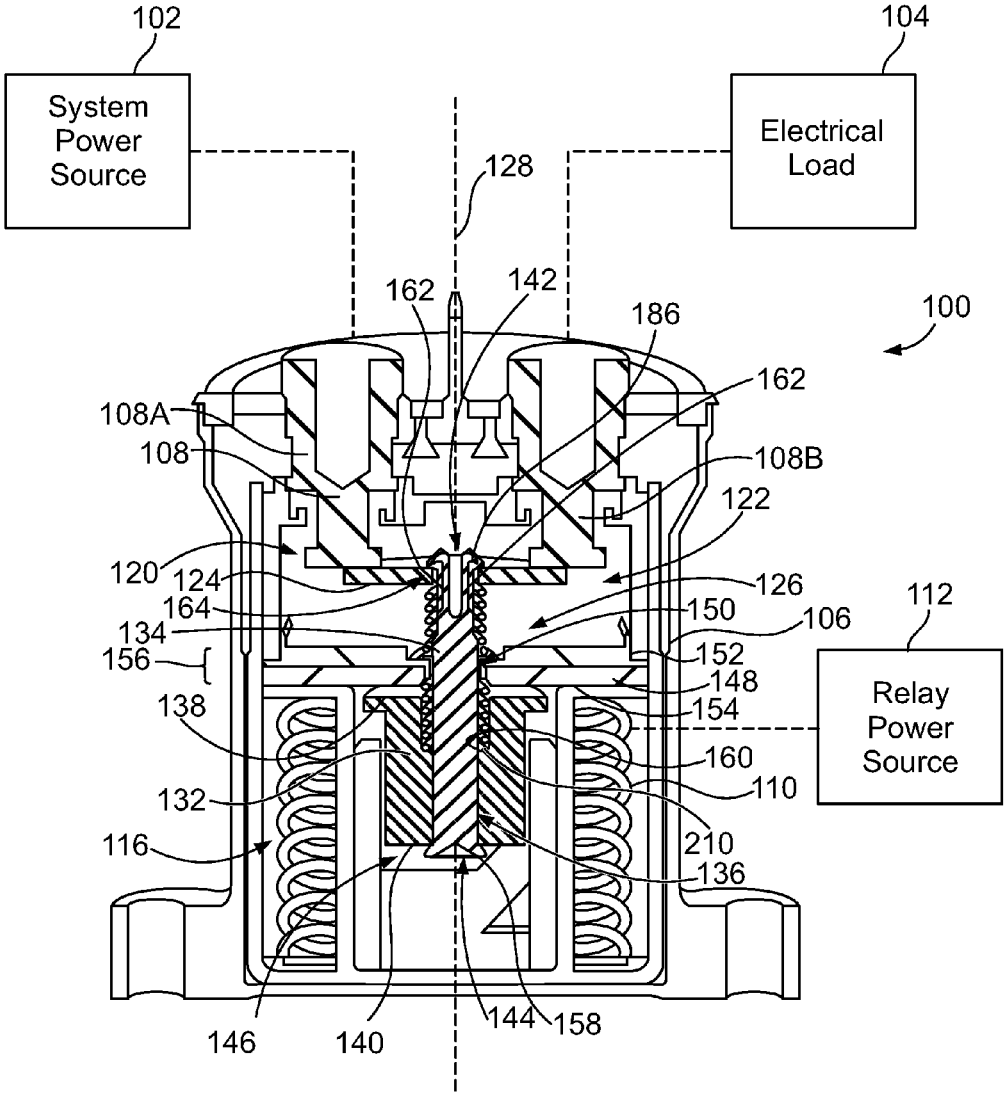
FIG. 2 is a front cross-sectional view of the electrical relay device of FIG. 1 with an actuator assembly in a second position.

FIG. 2 is a front cross-sectional view of the electrical relay device 100 with the actuator assembly 122 in the second position. When the actuator assembly 122 is in the second position, the movable contact 124 engages the stationary contacts 108 such that the movable contact 124 is conductively coupled to both stationary contacts 108. There is no longer a gap 130 (shown in FIG. 1) between the movable contact 124 and the stationary contacts 108. The second position of the actuator assembly 122 may be referred to herein as a closed circuit position. The movable contact 124, when in the closed circuit position, provides a closed circuit path between the two stationary contacts 108. For example, electrical current is allowed to flow from one stationary contact 108 to the other stationary contact 108 across the movable contact 124, which bridges the distance between the stationary contacts 108. In the illustrated embodiment, when the actuator assembly 122 is in the closed circuit position, electrical current from the system power source 102 is conveyed to a first stationary contact 108A of the stationary contacts 108, along the movable contact 124, through a second stationary contact 108B of the stationary contacts 108, and to the electrical load 104 to power the load 104. In response to the actuator assembly 122 moving to the open circuit position, the movable contact 124 disengages the stationary contacts 108, which breaks the circuit and cuts off the flow of electrical current between the system power source 102 and the electrical load 104. Although two stationary contacts 108 are shown in FIGS. 1 and 2, it is recognized that the electrical relay device 100 in other embodiments may have a different number of stationary contacts 108 and/or a different arrangement of stationary contacts 108. For example, the movable contact 124 may be permanently electrically connected one stationary contact and may be configured to move relative to a second stationary contact, to engage and disengage the second stationary contact, in order to close and open a circuit between the two stationary contacts.

The position of the actuator assembly 122, and the movable contact 124 thereof, is controlled by the relay power source 112, which controls the supply of current to the wire coil 110 to induce the magnetic field. For example, the actuator assembly 122 may be in the open circuit position in response to the relay power source 112 not supplying electrical current to the wire coil 110 or in response to the relay power source 112 supplying an electrical current to the wire coil 110 that has insufficient voltage to induce a magnetic field capable of moving the actuator assembly 122 to the closed circuit position. The actuator assembly 122 may be moved to the closed circuit position in response to the relay power source 112 providing an electrical current to the wire coil 110 that has sufficient voltage to induce a magnetic field that moves the actuator assembly 122 to the closed circuit position. The relay power source 112 may provide between 2 and 20 V of electrical energy to the wire coil 110 in order to move the actuator assembly 122 from the open circuit position to the closed circuit position. In an embodiment, the relay power source 112 provides 12 V of electrical energy to move the actuator assembly 122. By comparison, the system power source 102 may provide electrical energy through the electrical relay device 100 at higher voltages, such as at 120V, 220V, or the like. The flow of current from the relay power source 112 to the wire coil 110 is selectively controlled to selectively operate the electrical relay device 100. For example, the relay power source 112 may be actuated by a human operator and/or may be actuated automatically by an automated controller (not shown) that includes one or more processors or other processing units.

The carrier sub-assembly 126 includes a plunger 132 and a shaft 134. The plunger 132 defines a channel 136 that extends axially through the plunger 132 between a top side 138 and a bottom side 140 of the plunger 132. The shaft 134 is held within the channel 136 of the plunger 132. The shaft 134 is directly secured to the plunger 132. As used herein, two components are "directly secured" to one another when the two components mechanically engage one another and are fixed to one another without any discrete components between the two components that are used to secure the two components together. Examples of such discrete components include fasteners that are separate from the shaft 134 and the plunger 132, such as E-clips and C-clips (which are prone to dislodging due to vibration and/or other forces encountered during use).

The shaft 134 and the plunger 132 are configured to move together within the electrical relay device 100 along the actuation axis 128. The shaft 134 extends between a contact end 142 and an opposite plunger end 144. The shaft 134 extends through the channel 136 of the plunger 132 such that a segment of the shaft 134 protrudes from the top side 138 of the plunger 132. The segment of the shaft 134 protruding from the top side 138 includes the contact end 142 of the shaft 134. The shaft 134 secures to the movable contact 124 at or proximate to the contact end 142. The movable contact 124 is spaced apart from the plunger 132 along the actuation axis 128. In an embodiment, the shaft 134 directly secures to the plunger 132 at or proximate to the plunger end 144, and the shaft 134 directly secures to the movable contact 124 at or proximate to the contact end 142. The shaft 134, the plunger 132, and the movable contact 124 of the actuator assembly 122 are configured to move together along the actuation axis 128 towards and away from the stationary contacts 108.

In an embodiment, the movable contact 124 is disposed within the electrical circuit region 120 of the housing 106, the plunger 132 is disposed within the electromagnetic region 116 of the housing 106, and the shaft 134 extends into both the electrical circuit region 120 and the electromagnetic region 116. For example, the contact end 142 of the shaft 134 is within the electrical circuit region 120, and the plunger end 144 is within the electromagnetic region 116. The electrical relay device 100 may further include a core plate 148 that is coupled to the housing 106 and fixed in place relative to the housing 106. The core plate 148 may define at least part of a divider wall 156 between the electrical circuit region 120 above and the electromagnetic region 116 below. The core plate 148 defines an opening 150 that receives the shaft 134 therethrough. The shaft 134 extends through the opening 150 of the core plate 148 such that the contact end 142 is above a top side 152 of the core plate 148 and the plunger end 144 is below a bottom side 154 of the core plate 148. The core plate 148 is disposed between the movable contact 124 and the plunger 132. In an embodiment, the top side 138 of the plunger 132 is configured to engage the bottom side 154 of the core plate 148 when the actuator assembly 122 is in the closed circuit position, as shown in FIG. 2. For example, the bottom side 154 of the core plate 148 may provide a hard stop surface that limits the movement of the actuator assembly 122 towards the stationary contacts 108 to prevent excess movement that may damage the movable contact 124 or other components of the electrical relay device 100.

The plunger 132 may be surrounded by the coil 110 of wire. For example, the plunger 132 is disposed within a passage 146 that is radially interior of the wire coil 110. The plunger 132 is formed of a ferromagnetic material. For example, the plunger 132 may be formed of iron, nickel, cobalt, and/or an alloy containing one or more of iron, nickel, and cobalt. The plunger 132 has magnetic properties that allow the plunger 132 to translate in the presence of an induced magnetic field by the wire coil 110. In an embodiment, the shaft 134 is formed of a metal material that is different than the ferromagnetic material of the plunger 132. For example, the ferromagnetic material of the plunger 132 has a greater magnetic permeability than the metal material of the shaft 134. As used herein, magnetic permeability refers to a degree of magnetization that a material obtains in response to an applied magnetic field. The metal material of the shaft 134 optionally may be aluminum, titanium, zinc, or the like, or an alloy such as stainless steel or brass.

Figure 5:
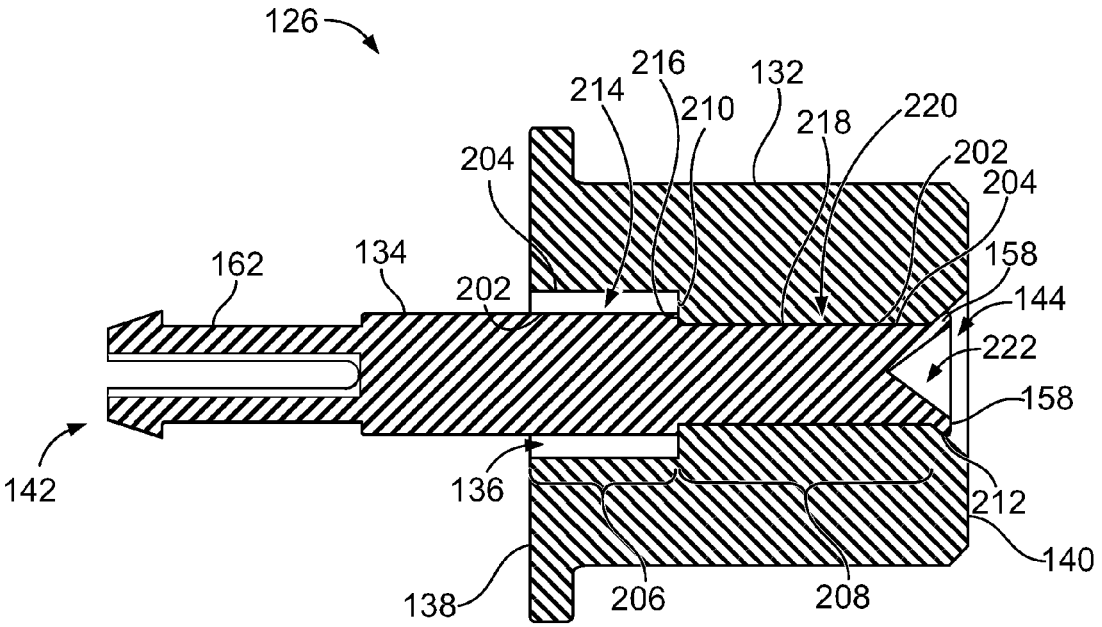
FIG. 5 is a cross-sectional view of the carrier sub-assembly of the electrical relay device according to an embodiment.

The shaft 134 is directly secured to the plunger 132 without using any intervening discrete components, such as bolts, screws, C-clips, E-clips, and other fasteners, and also adhesives that provide a chemical bond. The shaft 134 may be held within the channel 136 of the plunger 132 via an interference fit. The shaft 134 may additionally or alternatively be secured within the channel 136 via flanges on the shaft 134 that mechanically engage corresponding shoulders and/or surfaces of the plunger 132. In the illustrated embodiment, the shaft 134 includes an end flange 158 at the plunger end 144. The end flange 158 has a greater diameter than the channel 136 at the bottom side 140 of the plunger 132. As a result, the end flange 158 engages the bottom side 140 of the plunger 132. The end flange 158 abuts the bottom side 140, which prohibits the shaft 134 from moving axially relative to the plunger 132 (for example, from being pulled out of the channel 136) in a direction from the bottom side 140 towards the top side 138 of the plunger 132. In another embodiment, the end flange 158 is configured to engage a bottom shoulder 212 (shown in FIG. 5) of the plunger 132 that is proximate to the bottom side 140 instead of engaging the bottom side 140. The shaft 134 also may include an intermediate flange 160 located along a segment of the shaft 134 within the channel 136 of the plunger 132 and spaced apart from the end flange 158. The intermediate flange 160, as described in more detail with reference to FIG. 5, is configured to engage a second shoulder 210 of the plunger 132 within the channel 136. The intermediate flange 160 may abut the second shoulder to prohibit the shaft 134 from moving axially relative to the plunger 132 (for example, from being pulled out of the channel 136) in a direction from the top side 138 of the plunger 132 towards the bottom side 140. Thus, the end flange 158 and the intermediate flange 160 may functionally lock the shaft 134 axially to the plunger 132, which directly secures the shaft 134 to the plunger 132.

In an embodiment, the shaft 134 is directly secured to the movable contact 124 at or proximate to the contact end 142 such that no intervening fastener is used to secure the shaft 134 to the movable contact 124. In the illustrated embodiment, the contact end 142 of the shaft 134 is defined by at least two deflectable prongs 162. The prongs 162 are configured to extend through an aperture 164 in the movable contact 124. The prongs 162 have catch surfaces 186 (shown in more detail in FIG. 3) that engage the movable contact 124 to directly secure the shaft 134 to the movable contact 124. The movable contact 124 is formed of an electrically conductive first metal material, such as copper and/or silver. The movable contact 124 in an embodiment may be solid copper that is optionally silver-plated. The shaft 134 is formed of a different, second metal material, such as stainless steel (as described above). The first metal material of the movable contact 124 has a greater electrical conductivity than the second metal material of the shaft 134. Thus, the movable contact 124 conducts electricity more readily or to a greater degree than the shaft 134. Put another way, current flows with less resistance along the movable contact 124 than along the shaft 134. As a result, when the actuator assembly 122 is in the closed circuit position as shown in FIG. 2 and the movable contact 124 engages the stationary contacts 108, a substantial majority of the electrical energy propagates along the movable contact 124 between the stationary contacts 108 and an insubstantial amount of electrical energy, if at all, propagates along the shaft 134.

Figure 3:
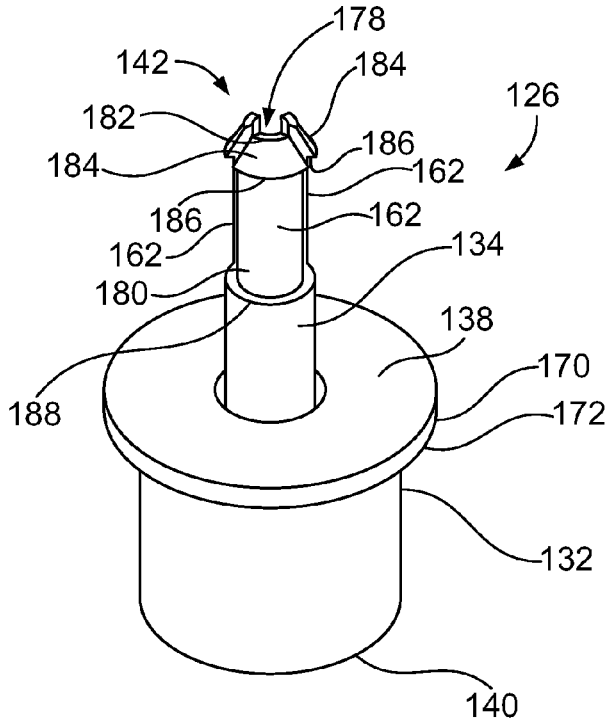
FIG. 3 is a perspective view of a carrier sub-assembly of the electrical relay device according to an embodiment.

FIG. 3 is a perspective view of the carrier sub-assembly 126 of the electrical relay device 100 (shown in FIG. 1) according to an embodiment. In the illustrated embodiment, the plunger 132 has a generally cylindrical shape extending between the top side 138 and the bottom side 140. The plunger 132 optionally includes a flange 170 that defines the top side 138. A bottom lip 172 of the flange 170 may be configured to engage ends 174 (shown in FIG. 1) of guide walls 176 (FIG. 1). For example, the guide walls 176 may guide the movement of the actuator assembly 122 (FIG. 1) along the actuator axis 128 (FIG. 1). The ends 174 of the guide walls 176 may be configured to provide a hard stop surface that prevents the actuator assembly 122 from moving excessively in a direction away from the stationary contacts 108. The bottom lip 172 of the flange 170 optionally may abut the ends 174 of the guide walls 176 when the actuator assembly 122 is in the open circuit position, as shown in FIG. 1. Although the plunger 132 is described as having a generally cylindrical shape, the plunger 132 may have other shapes in other embodiments, such as a prism shape with any number of sides. In an embodiment, the plunger 132 is a single, unitary component that is formed via a molding process, such as die casting, injection molding, or the like.

The contact end 142 of the shaft 134 is defined by at least two deflectable prongs 162. The shaft 134 includes three deflectable prongs 162 in the illustrated embodiment, but other embodiments may include two prongs 162 or more than three prongs 162. The prongs 162 define a cavity 178 therebetween. The deflectable prongs 162 each have a fixed end 180 and a free end 182. The fixed ends 180 hold the prongs 162 onto the shaft 134. The free ends 182 of the prongs 162 are supported by the fixed ends 180 and together define the contact end 142 of the shaft 134. The deflectable prongs 162 are configured to deflect radially inward at least partially into the cavity 178. For example, as the contact end 142 of the shaft 134 is loaded through the aperture 164 (shown in FIG. 2) of the movable contact 124 (FIG. 2) during assembly of the electrical relay device 100 (FIG. 2), the prongs 162 may deflect at least partially into the cavity 178 to reduce the diameter of the shaft 134 at the contact end 142 and allow the contact end 142 to be received within the aperture 164. In an embodiment, the deflectable prongs 162 are configured to resiliently return towards an original position once a biasing force is removed. The deflectable prongs 162 are in the original position in FIG. 3. The biasing force may be a normal force exerted on the prongs 162 by interior walls that define the aperture 164 of the movable contact 124. The biasing force may be removed once certain portions of the prongs 162 extend beyond the aperture 164. When the prongs 162 resiliently return towards the original position, the prongs 162 extend radially outward from the deflected positions, which increases the diameter of the shaft 134 at the contact end 142. The prongs 162 engage the movable contact 124 and directly secure the movable contact 124 to the shaft 134. It is recognized that the prongs 162 resiliently return in a direction "towards" the original position once the biasing force is removed, but may not necessarily achieve the original position due to residual biasing forces on the prongs 162 or the like.

Figure 4:
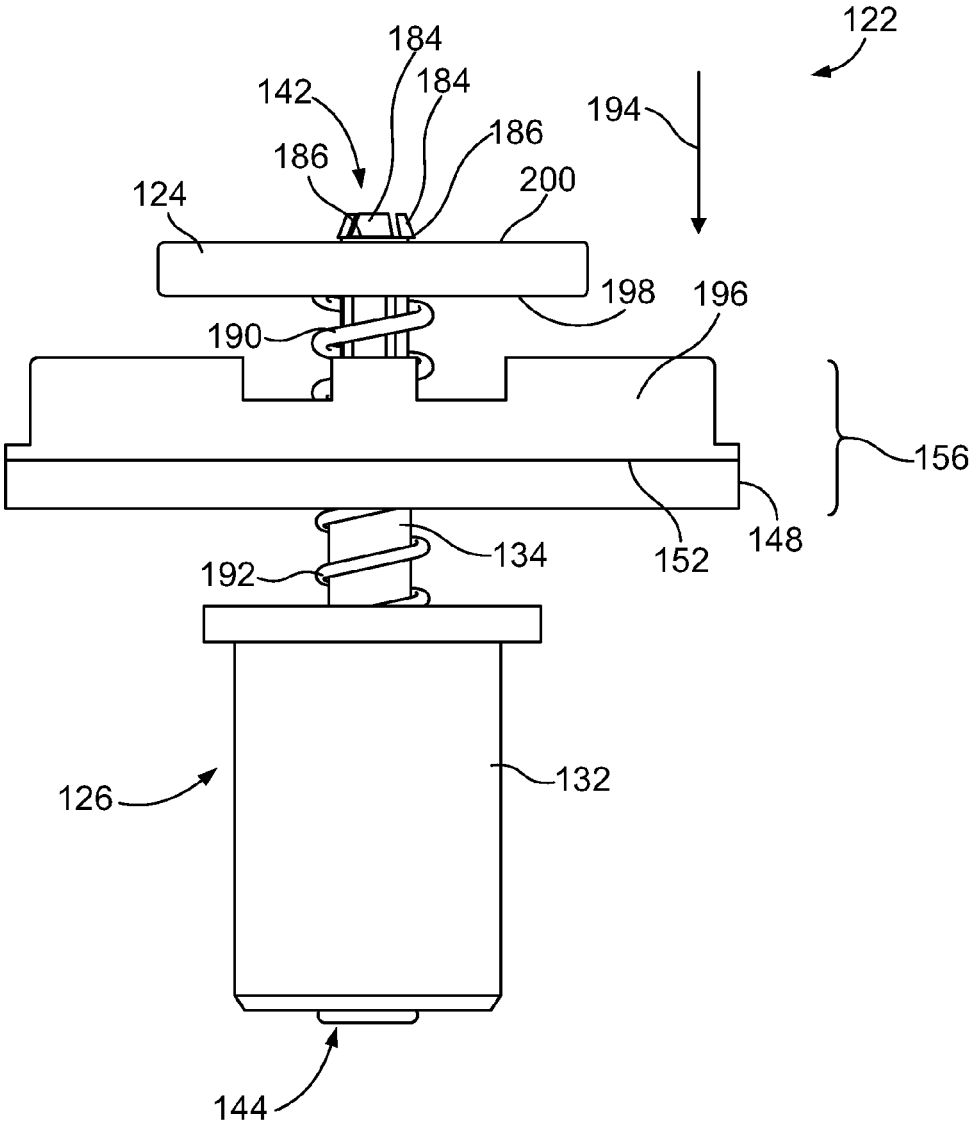
FIG. 4 is front view of an actuator assembly of the electrical relay device with various additional components loaded thereon according to an embodiment.

In the illustrated embodiment, the deflectable prongs 162 each include a hook feature 184 at the respective free end 182. The hook feature 184 protrudes radially outward. The hook feature 184 defines a catch surface 186. The catch surface 186 of each hook feature 184 generally faces towards the top side 138 of the plunger 132. In an embodiment, as shown in FIG. 4 below, the catch surfaces 186 of the deflectable prongs 162 are configured to engage the movable contact 124 once the deflectable prongs 162 have resiliently returned towards the original position to secure the movable contact 124 to the shaft 134. In an embodiment, the shaft 134 is a single, unitary component such that the deflectable prongs 162 are integral to the other segments of the shaft 134. The shaft 134 optionally may be stamped and formed (or rolled) into a cylindrical shape from a sheet or panel of metal. Alternatively, the shaft 134 may be molded, such as via die casting, injection molding, or the like. In an alternative embodiment, the shaft 134 does not include deflectable prongs at the contact end 142. For example, the contact end 142 may have a rigid structure that includes an annular flange that defines the catch surface 186. The flange may be greater in size than the aperture 164, and the shaft 134 may be coupled to the movable contact 124 by loading the plunger end 144 first through the aperture 164 (instead of the contact end 142 first).

FIG. 4 is front view of the actuator assembly 122 of the electrical relay device 100 (shown in FIG. 1) with various additional components loaded thereon according to an embodiment. The illustrated components include the divider wall 156, a contact spring 190, and a plunger spring 192. The contact spring 190 surrounds a segment of the shaft 134 that is axially between the movable contact 124 and the plunger 132. More specifically, the contact spring 190 surrounds the segment of the shaft 134 that extends between the movable contact 124 and the divider wall 156. The plunger spring 192 surrounds a different segment of the shaft 134 that extends between the divider wall 156 and the plunger 132. The springs 190, 192 are used to bias the actuator assembly 122 relative to the divider wall 156. For example, the springs 190, 192 may control the location of the actuator assembly 122 when the actuator assembly 122 is not influenced by an induced magnetic field, such as when the actuator assembly 122 is in the open circuit position.

The various components shown in FIG. 4 are assembled onto the carrier sub-assembly 126 by loading the components onto the shaft 134. For example, the shaft 134 is directly secured to the plunger 132 to form the carrier sub-assembly 126, and the other components are subsequently loaded onto the shaft 134. In an embodiment, the components are loaded one by one in a loading direction 194 from the contact end 142 of the shaft 134 towards the plunger end 144. The plunger spring 192 may be loaded onto the shaft 134 in the loading direction 194 first. The divider wall 156 is loaded onto the shaft 134 after the plunger spring 192. The divider wall 156 in an embodiment includes the core plate 148 and a guide layer 196 disposed on the top side 152 of the core plate 148. The guide layer 196 may be coupled to the core plate 148 to define the divider wall 156 prior to being loaded onto the shaft 134, or may be loaded onto the shaft 134 separate from, and subsequent to, the core plate 148 being loaded onto the shaft 134. In an embodiment, the divider wall 156 engages a shoulder 188 (shown in FIG. 3) of the shaft 134, either directly or indirectly via a washer (not shown) or another component, which provides a hard stop surface that prevents further movement of the divider wall 156 in the loading direction 194. The contact spring 190 is loaded onto the shaft 134 subsequent to the guide layer 196. The contact spring 190 may engage the guide layer 196 directly or indirectly through a washer (not shown) or the like. The movable contact 124 is loaded onto the shaft 134 after the contact spring 190.

The movable contact 124 has an inner side 198 and an opposite, outer side 200. The inner side 198 of the movable contact faces towards the divider wall 156. The contact spring 190 is configured to engage the inner side 198. As the movable contact 124 is loaded onto the shaft 134 over the contact end 142, the hook features 184 of the deflectable prongs 162 engage the interior walls (not shown) that define the aperture 164 (shown in FIG. 2) of the movable contact 124 proximate to the inner side 198. The prongs 162 deflect radially inward to allow the hook features 184 to be received through the aperture 164 as the movable contact 124 is moved in the loading direction 194. Once the hook features 184 of the prongs 162 clear the edge of the aperture 164 at the outer side 200 of the movable contact 124, the deflectable prongs 162 resiliently return towards the respective original positions. For example, the deflectable prongs 162 move radially outward such that the hook features 184 partially overlap the outer side 200 of the movable contact 124 around the aperture 164. In an embodiment, the catch surfaces 186 of the hook features 184 are configured to engage the outer side 200 of the movable contact 124. The catch surfaces 186 abut the outer side 200 to prohibit the movable contact 124 from moving in a direction opposite the loading direction 194 relative to the shaft 134. In an embodiment, the contact spring 190 is configured to apply a spring force on the inner side 198 of the movable contact 124 to force the movable contact 124 into engagement with the catch surfaces 186. The contact spring 190 is configured to control the spacing between the movable contact 124 and the guide layer 196 of the divider wall 156. In an embodiment, no fasteners or other discrete components are used to secure the movable contact 124, the divider wall 156, the contact spring 190, or the plunger spring 192 to the carrier sub-assembly 126.

FIG. 5 is a cross-sectional view of the carrier sub-assembly 126 of the electrical relay device 100 (shown in FIG. 1) according to an embodiment. As stated above, the shaft 134 is directly secured to the plunger 132, meaning that a discrete fastener, such as a clip, is not used to secure the shaft 134 to the plunger 132. The shaft 134 may be directly secured to the plunger 132 by an interference fit within the channel 136. For example, an outer surface 202 of the shaft 134 may engage interior walls 204 of the plunger 132 that define the channel 136. The diameter of the channel 136 may be approximately equal to the diameter of one or more segments of the shaft 134 within the channel 136, such that the outer surface 202 significantly engages and interferes with the interior walls 204 of the plunger 132. The outer surface 202 of the shaft 134 optionally may include crush ribs (not shown) or other protrusions that engage the interior walls 204 and increase the amount of interference.

In the illustrated embodiment, the plunger 132 defines a broad region 206 of the channel 136 and a narrow region 208 of the channel 136. The broad region 206 extends from the top side 138 of the plunger 132 to the narrow region 208, and the narrow region 208 extends from the broad region 206 towards the bottom side 140 of the plunger 132. The narrow region 208 does not extend fully to the bottom side 140 in the illustrated embodiment because the interior walls 204 define a flared bottom shoulder 212 between the narrow region 208 and the bottom side 140. In an alternative embodiment, however, the narrow region 208 extends fully to the bottom side 140. The broad region 206 has a greater diameter than the narrow region 208. The interior walls 204 of the plunger 132 define a shoulder 210 within the channel 136 that separates the broad region 206 from the narrow region 208.

Optionally, the broad region 206 has a diameter that is greater than a diameter of the segment of the shaft 134 disposed within the broad region 206 such that a radial gap 214 extends between the interior walls 204 of the plunger 132 and the outer surface 202 of the shaft 134. The radial gap 214 may have a ring shape that extends fully around the perimeter of the shaft 134. In an embodiment, the radial gap 214 is configured to receive a portion of the plunger spring 192 (shown in FIG. 4) therein. An end of the plunger spring 192 may engage and apply a spring force onto the shoulder 210 within the channel 136.

In the illustrated embodiment, the shaft 134 includes the end flange 158 at the plunger end 144 of the shaft 134, and the shaft 134 also includes an intermediate flange 216 that is spaced apart from end flange 158. For example, the intermediate flange 216 is disposed more proximate to the contact end 142 than the relative location of the end flange 158 to the contact end 142. The intermediate flange 216 is disposed on a segment of the shaft 134 that is received within the channel 136, such that the intermediate flange 216 is located within the channel 136. A narrow segment 218 of the shaft 134 extends between the end flange 158 and the intermediate flange 216. The end flange 158 and the intermediate flange 216 both are stepped radially outward from the outer surface 202 of the shaft 134 along the narrow segment 218. The end flange 158 and the intermediate flange 216 define a recess 220 therebetween. The recess 220 extends axially along the length of the narrow segment 218 and radially between the outer surface 202 of the narrow segment 218 and the outer surface 202 of the end flange 158 and/or the intermediate flange 216.

In an embodiment, the interior walls 204 of the plunger 132 along the narrow region 208 extend into the recess 220 between the end flange 158 and the intermediate flange 216 to secure an axial position of the shaft 134 relative to the plunger 132. For example, the narrow region 208 of the channel 136 may have an axial length that is less than or approximately equal to an axial length of the narrow segment 218 of the shaft 134 such that the interior walls 204 are received within the recess 220. The intermediate flange 216 of the shaft 134 may be configured to engage the shoulder 210 of the plunger 132 within the channel 136 to restrict axial movement of the shaft 134 relative to the plunger 132 in a direction from the top side 138 of the plunger 132 to the bottom side 140. In addition, the end flange 158 may be configured to engage the bottom shoulder 212 (or the bottom side 140) of the plunger 132 to restrict axial movement of the shaft 134 relative to the plunger 132 in an opposite direction from the bottom side 140 to the top side 138. Thus, the narrow region 208 of the channel 136 is received in the recess 220 of the shaft 134, which directly secures the shaft 134 to the plunger 132, effectively mechanically locking the shaft 134 within the channel 136 of the plunger 132. Optionally, the diameter of the narrow region 208 of the channel 136 may be approximately equal to a diameter of the narrow segment 218 of the shaft 134 such that little to no clearance exists between the interior walls 204 of the plunger 132 and the outer surface 202 of the shaft 134. The interior walls 204 engage the outer surface 202, providing an interference fit that supports the coupling of the shaft 134 to the plunger 132.

In an embodiment, the end flange 158 of the shaft 134 is formed in-situ after loading the shaft 134 into the channel 136 of the plunger 132. For example, the shaft 134 may be loaded into the channel 136 from the top side 138 towards the bottom side 140. The plunger end 144 of the shaft 134 may be mechanically flared or spread outward to form the end flange 158 after the shaft 134 is loaded into the channel 136 such that the end flange 158 extends radially outward beyond at least a portion of the bottom shoulder 212, as shown in FIG. 5. In an alternative embodiment, the plunger end 144 is flared to extend radially outward beyond at least a portion of the bottom side 140 of the plunger 132. The plunger end 144 may be mechanically flared or spread using a tool that cuts and bends the metal material of the shaft 134. For example, the plunger end 144 in the illustrated embodiment includes an indentation 222 that may be formed by mechanically cutting and flaring the plunger end 144 to form the end flange 158 after the shaft 134 is loaded into the channel 136. Alternatively, the indentation 222 may be pre-formed along the plunger end 144 of the shaft 134 prior to loading the shaft 134 into the channel 136.

In an alternative embodiment, the shaft 134 may be directly secured to the plunger 132 via a threaded coupling. For example, the outer surface 202 of the shaft 134 may define helical threads (not shown) along at least a segment of the shaft 134 that engages the interior walls 204 of the plunger 132 (such as the narrow segment 218 of the shaft 134 shown in FIG. 5). In addition, the interior walls 204 of the plunger 132 may include complementary helical threads along at least a region of the channel 136 that engages the outer surface 202 of the shaft 134 (such as the narrow region 208 of the channel 136 shown in FIG. 5). The shaft 134 may be loaded into the channel 136 by rotating the shaft 134 (and/or the plunger 132) such that the complementary threads engage one another, and the shaft 134 is effectively screwed into the channel 136 of the plunger 132. Optionally, the shaft 134 and the plunger 132 may be threadably coupled in addition to using the end flange 158 and the intermediate flange 216 to lock the axial position of the shaft 134 within the channel 136.

In another alternative embodiment, instead of flaring or spreading the plunger end 144 of the shaft 134 after loading the shaft 134 into the channel 136, the plunger end 144 may be formed to include deflectable prongs (not shown), which may be similar to the prongs 162 at the contact end 142 of the shaft 134. For example, the deflectable prongs at the plunger end 144 may be configured to deflect radially inwards as the prongs are loaded through the channel 136 (such as through the narrow region 208 of the channel 136). Once hook features at ends of the prongs protrude beyond the bottom shoulder 212 and/or beyond the bottom side 140 of the plunger 132, the prongs may resiliently return towards an unbiased position. The prongs returning towards the unbiased position may extend radially outward to engage the bottom shoulder 212 and/or the bottom side 140 to directly secure the shaft 134 to the plunger 132. The prongs at the plunger end 144 may be used in addition to threadably coupling the shaft 134 to the plunger 132, providing an interference fit between the shaft 134 and the plunger 132, and/or other coupling means in order to directly secure the shaft 134 to the plunger 132. In an alternative embodiment, the shaft 134 does not include the deflectable prongs 162 at the contact end 142.

Figure 6:
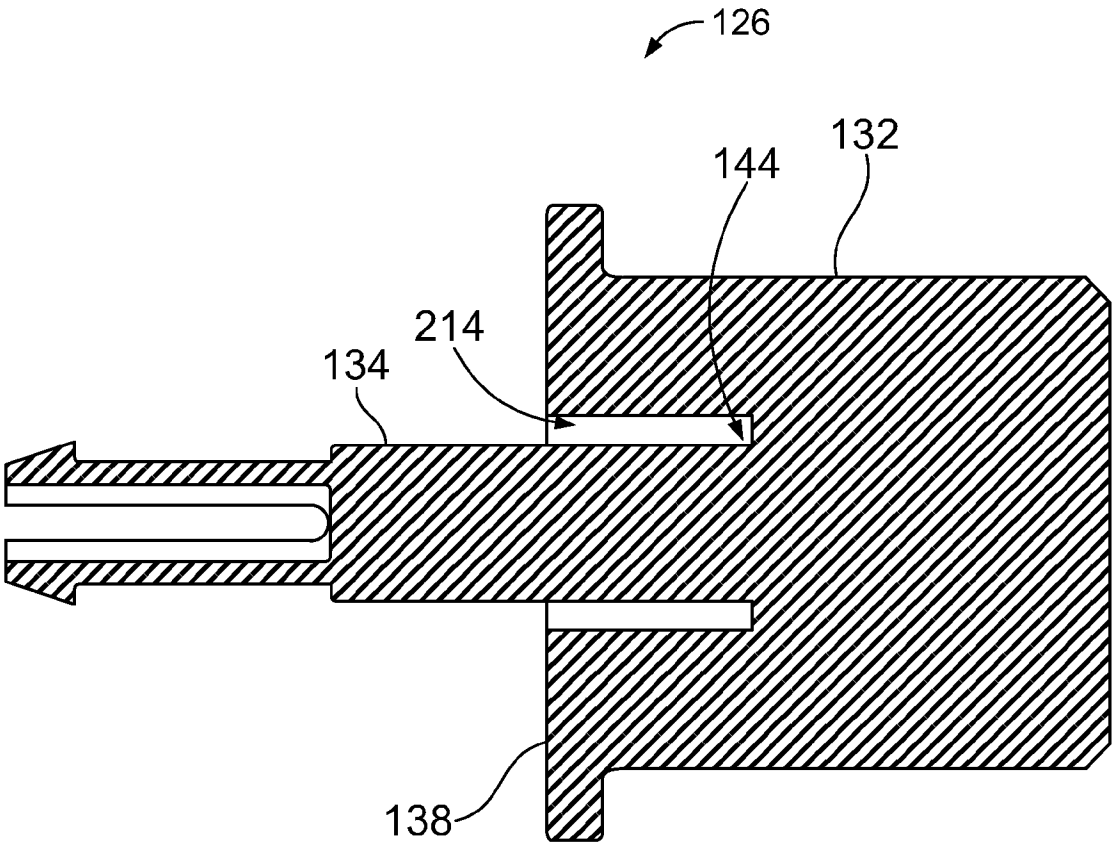
FIG. 6 is a cross-sectional view of the carrier sub-assembly of the electrical relay device according to an alternative embodiment.

FIG. 6 is a cross-sectional view of the carrier sub-assembly 126 of the electrical relay device 100 (shown in FIG. 1) according to an alternative embodiment. Like the carrier sub-assembly 126 shown and described in FIG. 5, the carrier sub-assembly 126 of FIG. 6 includes the shaft 134 that is directly secured to the plunger 132. But, unlike, the carrier sub-assembly 126 shown in FIG. 5, the carrier sub-assembly 126 of FIG. 6 is a one-piece component in which the shaft 134 and the plunger 132 are formed integral to one another. The shaft 134 is directly secured to the plunger 132 (for example, without a discrete component between the shaft 134 and the plunger 132 securing the shaft 134 to the plunger 132) because the shaft 134 and the plunger 132 are both parts of the same unitary construction. For example, the plunger end 144 of the shaft 134 is fixed to the plunger 132. In the illustrated embodiment, the plunger end 144 is fixed to the plunger 132 at an axial location that is recessed relative to the top side 138 of the plunger 132. The radial gap 214 that is configured to receive the plunger spring 192 (shown in FIG. 4) is defined axially between the top side 138 and the location where the plunger end 144 of the shaft 134 is fixed to the plunger 132.

The plunger 132 and the shaft 134 are both at least partially formed of a common metal material. The plunger 132 is formed at least partially of a ferromagnetic material. In one embodiment, the common metal material is a ferromagnetic material, such as iron, nickel, cobalt, and/or an alloy thereof, such that the shaft 134 and the plunger 132 are both formed of the ferromagnetic material. The shaft 134 may be subsequently coated, such as via plating, painting, spraying, or the like, in a second metal material that has a reduced magnetic permeability relative to the ferromagnetic material used to form the shaft 134 and the plunger 132. The second metal material may reduce the magnetic permeability of the shaft 134 without affecting the magnetic permeability of the plunger 132. In another embodiment, the common metal material used to form the plunger 132 and the shaft 134 is either not a ferromagnetic material or is a ferromagnetic material with a relatively low magnetic permeability, such as stainless steel. After the forming process, the plunger 132 may be coated, such as via plating, painting, spraying, or the like, in a second ferromagnetic material that has a greater magnetic permeability than the first ferromagnetic material used to form the shaft 134 and the plunger 132. The second ferromagnetic material may increase the magnetic permeability of the plunger 132 without affecting the magnetic permeability of the shaft 134.

As described herein, the actuator assembly 122 (shown in FIG. 1), including the movable contact 124 (FIG. 1) and the carrier sub-assembly 126 that includes the shaft 134 and the plunger 132, is assembled without the use of discrete components, such as E-clips, C-clips, which risk becoming dislodged during use of the electrical relay device 100 (FIG. 1). The shaft 134 is directly secured to the movable contact 124 and is separately directly secured to the plunger 132 without the use of any such discrete components.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A carrier sub-assembly for an electrical relay device, the carrier sub-assembly comprising:

a plunger formed of a ferromagnetic material, the plunger having a generally cylindrical shape extending between a top side and a bottom side of the plunger, the plunger defining a channel extending axially therethrough between the top side and the bottom side, and a shaft extending between a contact end and an opposite plunger end, the shaft extending through the channel of the plunger and being directly secured to the plunger within the channel without a discrete component between the shaft and the plunger securing the shaft to the plunger, the shaft and the plunger configured to move together within the electrical relay device, a segment of the shaft including the contact end protruding from the top side of the plunger for securing to a movable contact of the electrical relay device, wherein the shaft includes an end flange at the plunger end, the end flange having a greater diameter than the channel at or at least proximate to the bottom side of the plunger, the end flange engaging at least one of the bottom side of the plunger or a bottom shoulder of the plunger to secure the shaft to the plunger, wherein the shaft further includes an intermediate flange that is located within the channel of the plunger and spaced apart from the end flange, the end flange and the intermediate flange defining a recess therebetween, wherein interior walls of the plunger that define a narrow region of the channel extend into the recess to secure an axial position of the shaft relative to the plunger.

2. The carrier sub-assembly of claim 1, wherein the shaft is formed of a metal material that is different than the ferromagnetic material of the plunger, the ferromagnetic material of the plunger having a greater magnetic permeability than the metal material of the shaft.

3. The carrier sub-assembly of claim 1, wherein the contact end of the shaft is defined by at least two deflectable prongs, the deflectable prongs defining a cavity therebetween, the deflectable prongs configured to deflect at least partially into the cavity to allow the contact end of the shaft to be received in an aperture of the movable contact during assembly of the electrical relay device, the deflectable prongs configured to resiliently return towards an original position once a biasing force is removed to engage the movable contact and secure the movable contact to the shaft.

4. The carrier sub-assembly of claim 1, wherein the channel of the plunger includes a broad region that extends from the top side and the narrow region extends from the broad region towards the bottom side, the broad region having a greater diameter than the narrow region, the broad region separated from the narrow region by a shoulder of the plunger, the intermediate flange configured to engage the shoulder within the channel.

5. The carrier sub-assembly of claim 1, wherein an outer surface of the shaft engages interior walls of the plunger that define the channel.

6. The carrier sub-assembly of claim 1, wherein a diameter of the narrow region of the channel is approximately equal to a diameter of the shaft between the end flange and the intermediate flange such that the interior walls of the plunger along the narrow region engage an outer surface of the shaft via an interference fit.

7. The carrier sub-assembly of claim 1, wherein the channel of the plunger includes a broad region that extends from the top side to a shoulder within the channel, the broad region having a diameter that is greater than a diameter of a segment of the shaft within the broad region such that a radial gap extends between interior walls of the plunger that define the broad region and an outer surface of the shaft, the radial gap configured to receive a plunger spring therein.

8. The carrier sub-assembly of claim 1, wherein the end flange at the plunger end of the shaft is flared radially outward beyond at least a portion of the bottom side of the plunger or the bottom shoulder of the plunger.

9. An electrical relay device comprising:

a housing, two stationary contacts held within the housing and spaced apart from one another, a coil of wire within the housing, the coil of wire electrically connected to a relay power source, an actuator assembly disposed partially within the coil of wire within the housing, the actuator assembly including a movable contact coupled to a carrier sub-assembly, the actuator assembly being configured to move along an actuation axis between a first position and a second position based on a presence or absence of a magnetic field that is induced by current through the coil of wire, the movable contact of the actuator assembly being spaced apart from the stationary contacts when the actuator assembly is in the first position, the movable contact engaging the stationary contacts to provide a closed circuit path between the stationary contacts when the actuator assembly is in the second position, the movable contact having an inner side and an opposite, outer side, wherein the carrier sub-assembly includes a plunger and a shaft directly secured to one another without a discrete component between the shaft and the plunger securing the shaft to the plunger, the plunger being formed of a ferromagnetic material, the shaft protruding from a top side of the plunger and extending to a contact end of the shaft, the contact end including at least two deflectable prongs that extend through an aperture in the movable contact, the deflectable prongs having catch surfaces configured to engage the outer side of the movable contact to secure the movable contact to the shaft; and a contact spring surrounding the shaft axially between the movable contact and the plunger, the contact spring engaging the inner side of the movable contact to force the movable contact towards the catch surfaces of the deflectable prongs.

10. The electrical relay device of claim 9, wherein the deflectable prongs of the shaft define a cavity therebetween, the deflectable prongs configured to deflect at least partially into the cavity to allow the contact end of the shaft to be received in the aperture of the movable contact in a direction from the inner side to the outer side of the movable contact during assembly of the electrical relay device, the deflectable prongs being configured to resiliently return towards an original position once a biasing force is removed.

11. The electrical relay device of claim 9, wherein the deflectable prongs each include a hook feature at a free end, the hook feature of each deflectable prong defining the catch surface, the catch surfaces generally facing towards the top side of the plunger.

12. The electrical relay device of claim 9, wherein the shaft is formed integral to the plunger.

13. The electrical relay device of claim 9, wherein the shaft is discrete from the plunger and is formed of a metal material that is different than the ferromagnetic material of the plunger, the ferromagnetic material of the plunger having a greater magnetic permeability than the metal material of the shaft.

14. The electrical relay device of claim 9, wherein the movable contact is formed of a first metal material and the shaft is formed of a second metal material, the first metal material of the movable contact having a greater electrical conductivity than the second metal material of the shaft.

15. The electrical relay device of claim 9, wherein the shaft extends between the contact end and a plunger end and the plunger extends from the top side to a bottom side, the plunger defining a channel between the top side and the bottom side that receives the shaft therein, the shaft including an end flange at the plunger end that has a diameter greater than a diameter of the channel of the plunger at or at least proximate to the bottom side of the plunger, the end flange engaging at least one of the bottom side or a bottom shoulder of the plunger proximate to the bottom side.

16. The electrical relay device of claim 9, wherein the shaft extends between the contact end and a plunger end and the plunger extends from the top side to a bottom side, the plunger defining a channel between the top side and the bottom side that receives the shaft therein, the shaft including an end flange at the plunger end and an intermediate flange that is located within the channel of the plunger and is spaced apart from the end flange, the end flange and the intermediate flange defining a recess therebetween, interior walls of the plunger that define a narrow region of the channel extending into the recess to secure an axial position of the shaft relative to the plunger.

17. The electrical relay device of claim 9, wherein the housing includes a divider wall located between the movable contact and the plunger, the divider wall defining an opening that receives the shaft therethrough, the contact spring extending between and engaging the movable contact and the divider wall.

18. An actuator assembly for an electrical relay device comprising:

a movable contact; and a carrier subassembly coupled to the movable contact and configured to move with the movable contact along an actuation axis between a first position and a second position based on a presence or absence of a magnetic field to selectively engaging the movable contact with one or more stationary contacts of an electrical relay device to provide an electrical circuit path, wherein the carrier sub-assembly includes a plunger and a shaft, the plunger formed of a ferromagnetic material and having a top side and an opposite bottom side, the plunger defining a channel between the top side and the bottom side, the shaft having a contact end and an opposite plunger end, the shaft received in the channel of the plunger with the contact end protruding from the top side, the contact end engaging and coupling to the movable contact, the shaft including an end flange at the plunger end and an intermediate flange spaced apart from the end flange to define a recess therebetween, wherein interior walls of the plunger within the channel extend into the recess, the interior walls configured to engage the end flange and the intermediate flange to directly secure an axial position of the shaft relative to the plunger without a discrete component between the shaft and the plunger securing the shaft to the plunger.

19. The electrical relay device of claim 18, wherein the contact end of the shaft includes at least two deflectable prongs that extend through an aperture in the movable contact, the deflectable prongs having catch surfaces configured to engage an outer side of the movable contact to secure the movable contact to the shaft.

* * * * *